United States Patent [19]

Warren

[11] 4,187,419

[45] Feb. 5, 1980

[54] ELECTRICAL SWITCH

[75] Inventor: John Warren, Colne, England

[73] Assignee: Lucas Industries Limited, Birmingham, England

[21] Appl. No.: 875,925

[22] Filed: Feb. 7, 1978

[30] Foreign Application Priority Data

Feb. 8, 1977 [GB] United Kingdom ..... 5044/77

[51] Int. Cl.[2] ..... H01H 9/16

[52] U.S. Cl. ..... 200/308; 116/307

[58] Field of Search ..... 200/308, 309, 316; 116/124 L, 307

[56] References Cited

U.S. PATENT DOCUMENTS

| | | | |
|---|---|---|---|
| 3,227,831 | 1/1966 | Jacks et al. | 200/308 |
| 3,715,548 | 2/1973 | Schadow | 200/308 |
| 3,845,736 | 11/1974 | Golbeck et al. | 116/124 L |

FOREIGN PATENT DOCUMENTS

| | | | |
|---|---|---|---|
| 2231966 | 1/1974 | Fed. Rep. of Germany | 200/308 L |
| 1405381 | 5/1965 | France . | |
| 2207347 | 6/1974 | France . | |
| 425705 | 3/1935 | United Kingdom | 116/124 L |
| 477166 | 12/1937 | United Kingdom | 116/124 L |
| 860381 | 2/1961 | United Kingdom . | |
| 1021430 | 3/1966 | United Kingdom . | |

*Primary Examiner*—Richard R. Stearns
*Attorney, Agent, or Firm*—Holman & Stern

[57] ABSTRACT

An electrical switch including a fixed contact, a movable contact and means for moving the movable contact into and out of engagement with the fixed contact. A first legend indicative of one of the operative states of the switch is carried by a fixed part of the switch and a second legend indicative of the other operative state of the switch is carried by a part movable relative to the fixed part. The movable part is movable between a position wherein the first legend is revealed and the second legend is obscured and a position wherein the movable part obscures the first legend and the second legend is revealed. A resilient arrangement moves the movable part to one of the positions and there is provided a releasable latch arrangement for retaining the movable part in the other of the positions against the action of the resilient means. The switch incorporates a mechanism for releasing the latch at a predetermined point in the movement of the movable contact relative to the fixed contact and further includes a mechanism for returning the movable part against the action of said resilient means.

6 Claims, 3 Drawing Figures

FIG.1.
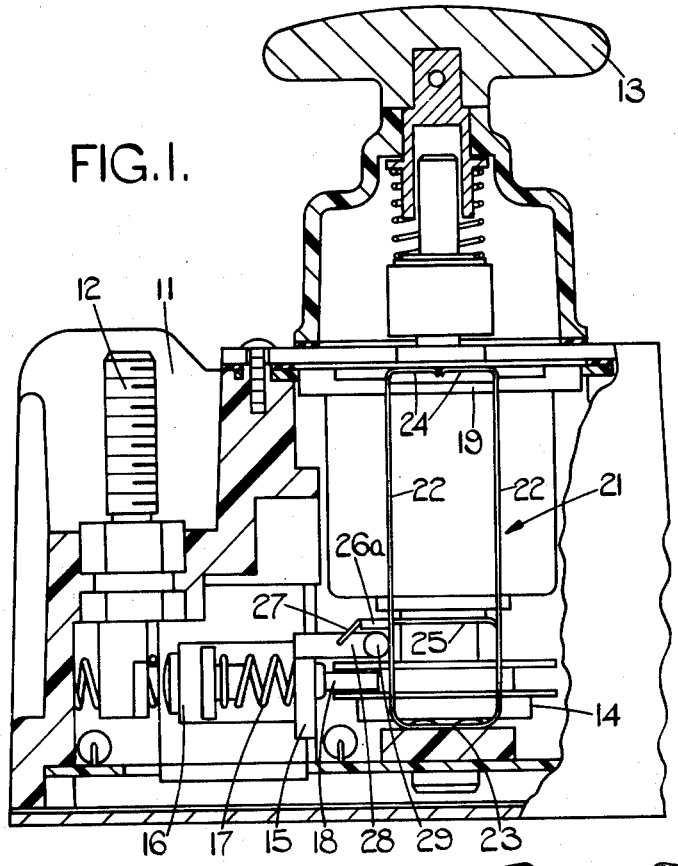
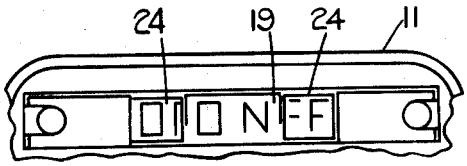
FIG.2.
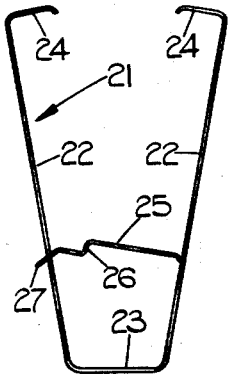
FIG.3.

ELECTRICAL SWITCH

This invention relates to an electrical switch of the kind having first and second operative states and means for providing a visual indication of the operative state of the switch, and has for its object to provide a switch of the kind specified in a simple and convenient form.

An electrical switch according to the invention includes a fixed electrical contact, a movable electrical contact, means for moving the movable contact into and out of engagement with the fixed contact, a first legend carried by a fixed part of the switch and indicative of one of the operative states of the switch, a second legend carried by a part movable relative to said fixed part and indicative of the other operative state of the switch, said movable part being movable between a position wherein the first legend is revealed and the second legend is obscured and a position wherein the movable part obscures the first legend and the second legend is revealed, resilient means urging said movable part to one of said positions, releasable latch means for retaining said movable part in the other of said positions against the action of said resilient means, release means for releasing said latch means at a predetermined point in the movement of the movable contact relative to the fixed contact and return means for returning the movable part against the action of said resilient means.

Preferably, said movable part is carried by a resilient limb one end of which is fixed, said limb constituting said resilient means.

Desirably, said movable part is in two relatively movable sections each carrying part of said second legend, said sections being resiliently urged in opposite directions and the two sections jointly obscuring the first legend in the appropriate position.

Preferably, each of said sections is carried by a respective resilient limb, each limb having one end fixed and constituting the resilient bias of its respective section.

Conveniently, the two limbs are resiliently biassed away from one another and said latch means is defined by a hooked arm on one of the limbs which engages the other limb to hold both limbs against their resilient bias with the two sections of said movable part obscuring the first legend.

Desirably, the movable contact of the switch is resiliently mounted on a carrier, the carrier being moved to move the movable contact and the resilient mounting permitting the carrier to move relative to the movable contact when engaged with the fixed contact so as to apply contact pressure, the latch release means being also carried by said carrier and being arranged to release said latch when the movable contact has engaged the fixed contact.

One example of the invention is illustrated in the accompanying drawings wherein:

FIG. 1 is a side elevational view of part of an electrical switch with the casing thereof omitted for clarity;

FIG. 2 is a fragmentary plan view of part of the switch shown in FIG. 1 again with part of the casing omitted for clarity; and FIG. 3 is a side elevational view of a minor modification of the indicator arrangement of the switch shown in FIG. 1.

Referring to the drawings, the electrical switch is a battery master control switch which basically comprises a fixed moulded synthetic resin body 11, supporting a first pair of fixed electrical contacts, one of which is shown at 12 and a second pair of fixed electrical contacts, not shown in the drawings but positioned diametrically opposite the first set of fixed contacts, that is to say to the right of the vertical centre-line of FIG. 1.

Rotatably mounted on the body 11 is an operating handle 13 coupled to a rotatable cam 14 within the body 11. The coupling between the handle 13 and the cam 14 is complex, but for the purposes of understanding the present invention, it is sufficient to recognise that rotation of the handle 13 is transmitted to the cam 14 to rotate the cam. Associated with the cam 14 is a first movable contact assembly including a moulded synthetic resin carrier 15 and a moving contact 16 which is capable of bridging the contact 12 and the other contact of the first set of fixed contacts. A similar moving contact assembly is disposed on the diametrically opposite side of the cam 14 from the first moving contact assembly and is similarly associated with the second set of fixed contacts. The moving contact of each of the moving contact assemblies is movably mounted on its respective carrier and is urged away from the carrier towards the fixed contacts by a spring 17. Each of the moving contact assembly carriers includes a cam follower 18 which rides on the cam surface of the rotatable cam 14. Rotation of the handle 13 is transmitted to the cam 14 and co-operation between the cam followers on the moving contact assemblies and the cam 14 during rotation of the cam 14 in one direction results in movement of the movable contacts of the assemblies into engagement with their respective fixed contacts. The two moving contact assemblies are moved in unison, the cam form on the cam 14 being in two similar parts each associated with a respective moving contact assembly. Rotation of the handle 13 and thus the cam 14 in the opposite direction permits withdrawal of the movable contact assemblies away from their fixed contacts under the action of the return springs, (not shown) to break the circuits through the switch. In addition the coupling between the handle and the cam permits the cam to be moved axially to permit instantaneous withdrawal of the contacts under the action of the return springs. A solenoid arrangement is incorporated into the coupling between the handle 13 and the cam 14, and is operable to move the cam 14 axially to effect said instantaneous return of the movable contacts from their closed position upon receipt of an electrical signal from for example, a push-button switch at a remote location. It will be appreciated that the movable contacts are moved through the intermediary of their carriers and the compression springs 17 and the arrangement is such that upon engagement of the movable contacts with their fixed contacts continued rotation of the cam 14 results in continued movement of the carriers thus compressing the springs 17 and loading the movable contacts against the fixed contacts to achieve a suitable contact pressure.

As the operative state of the contact assemblies, either made or broken, is not directly related to the angular position of the handle 13 relative to the body, since the movable contacts may be returned by axial movement of the cam upon operation of the solenoid, it is important to provide some visual indication of the operative state of the switch. In order to provide such visual indication legends are provided in a window in the body, or casing of the switch which is visible to the operator. The two legends can take a number of forms, for example they can be merely areas of colour, the two different colours denoting the two operative states, or alternatively, they can be written legends for example, OFF and ON. The actual nature of the legends is not important to the present invention, but for the purposes of the further description of the invention, it will be assumed that the legends are of the written type OFF and ON.

Beneath the window on the casing of the switch is a plate 19 bearing the legend ON. The width of the window in the casing is such as to permit the whole of the legend ON to be visible. Disposed within the casing 11 of the switch is a means for observing comprising an indicator member 21 formed from spring steel strip.

The member 21 comprises a pair of straight, resilient limbs 22 which are interconnected at one end by an integral portion 23 extending generally at right angles to the limbs. The portion 23 is fixedly secured, for example by rivetting to the casing 11 so as to support the indicator member in position. At their ends remote from the portion 23 the two limbs 22 are bent inwardly towards one another to define indicator sections 24 the length of each of which is equal to substantially half the length of the portion 23. The inherent resilience of the limbs 22 urges the limbs 22 apart, but it will be appreciated that by overcoming the inherent resilience of the limbs 22 they can be flexed towards one another, to a position wherein the free ends of the sections 24 abut and the member 21 defines a rectangle. One of the limbs 22 includes an integral arm 25 which extends towards the other limbs 22 and which is formed with a step 26. The arm 25 thus can be described as a hooked arm and the step 26 of the arm 25 is engageable with the other of the limbs 22 in the other position wherein the limbs 22 are parallel with the free ends of the sections 24 abutting. The step 26 engaging the other limb 22 thus holds the two limbs 22 parallel with one another with the sections 24 abutting until such time as the arm 25 is deflected to disengage the step 26 from the other limb whereupon the two limbs spring apart under their inherent resilience moving the sections 24 away from one another. The arm 25 further includes, at its free end, an integral inclined finger 27 whereby the arm 25 can be deflected to release the limbs. It will be understood that the arm 25 and the associated portion of the other limb define a latch mechanism for releasably retaining the limbs 22 of the carrier member in a position wherein the sections 24 are aligned and abutting. It will be noted that FIG. 1 shows the limbs 22 in their latched position whereas FIG. 3 shows the limbs in their released position. In addition, the arm 25 in FIG. 1 is slightly different to the arm 25 in FIG. 3 in that in place of the step 26 it incorporates a downwardly turned flange **26*a*. The flange 26*a* however fulfils exactly the same function as the step 26 in that in the latched position it abuts a surface on the other limb 22** to hold the two limbs flexed towards one another.

Adjacent the sections 24 the two limbs 22 are of reduced width, and pass through apertures in the platform 19 bearing the legend ON and opposite sides respectively of the legend. In the released position of the two limbs 22 the sections 24 reveal the legend ON and are themselves obscured by being beneath the portions of the casing 11 on opposite sides of the window. However, in the latched position of the limbs 22 shown in FIG. 1 the sections 24 abut at their free ends and thus obscure the platform 19 and the legend ON so that the legend is not visible through the window. The sections 24 carry parts of the legend OFF and thus when the sections 24 are abutting and obscuring the platform 19 the legend OFF is visible in the window. It will be understood therefore that by moving the limbs 22 between their flexed and latched positions, the legend visible in the window of the casing 11 is changed.

The arm 25 of the indicator member 21 is resiliently biassed by its own inherent resilience to a position wherein when the limbs 22 are parallel the step 26 or flange **26*a* engages the corresponding surface of the other limb to latch the limbs relative to one another. Thus merely by flexing the two limbs 22 to their parallel configuration the latch mechanism defined in part by the arm 25 will be operated to retain the limbs in their parallel configuration. Each of the carriers of the moving contact assemblies includes an extension 28 projecting towards its respective limb 22. The extension 28 of the carrier associated with the limb 22 which does not have the arm 25 is provided with a latch release peg 29 which as will be described hereinafter, can co-operate with the inclined finger 27 of the arm 25** to release the latch mechanism.

Assuming that the switch is in an off condition with the moving contacts of the moving contact assemblies spaced from their respective fixed contacts, then the limbs 22 of indicator member 21 will be latched in their parallel configuration so that the legend which is visible in the window of the switch is the OFF legend. Rotation of the handle 13 in the appropriate direction now causes, by virtue of rotation of the cam 14, movement of the moving contact assemblies towards their ON positions. During this movement the latch release peg 29 is moved away from the limb 22 towards the inclined surface of the finger 27, and the dimensions of the parts are so arranged that the peg 29 does not engage the inclined surface of the finger 27 until the moving contacts have actually engaged the fixed contacts and contact pressure has begun to be applied by the continued movement of the carriers relative to the movable contacts. Thereafter, co-operation of the peg 29 and the inclined finger 27 lifts the arm 27 against its inherent resilience to release the limbs 22. Thus at a point in time fractionally after closure of the contacts the limbs 22 are released and spring apart so that the sections 24 are obscured by the casing on either side of the window and the legend ON of the platform 19 is revealed.

With the limbs 22 in their flexed position the arm 25 is of course not at right angles to the limb 22 with which it co-operates to latch the limbs together. Thus during subsequent return movement of the limbs 22 against their inherent resilience the arm 25 can ride over the edge of the abutting surfaces of the other limb 22, flexing the arm 25, until such time that the step 26 or the equivalent surface of the flange **26*a*, aligns with the edge of the abutting surface of the limb 22 whereupon the arm 25 flexed back to latch the limbs 22** in their parallel configuration.

Return movement of the limbs 22 is effected by the extensions 28 of the carriers of the moving contact assemblies. As the moving contact assemblies are returned towards their OFF positions under the action of their respective return springs and irrespective of the manner in which return movement is initiated, the free ends of the extensions 28 engage their respective limbs 22 and thus flex the limbs 22 towards their parallel configuration, it being appreciated that the return spring of the moving contact assemblies will be substantially stronger than the resistance to such movement imparted by the resilience of the limbs 22.

In a modification (not shown) the limb 22 without the arm 25 is dispensed with, and the section 24 of the remaining limb is extended, and carries the whole of the OFF legend. The arm 25 co-operates with an abutment surface on the body 11 to latch the limb in a flexed configuration wherein the section 24 thereof obscures the ON legend and the operation of this modification is substantially identical to that described above with of course the exception that one of the moving contact assemblies operates the latch release, while the other of the moving contact assemblies effects the return movement of the limb.

In an alternative arrangement of this modification the switch incorporates only a single moving contact assembly and the latch arrangement for the flexible indicator limb is arranged to be operated by the single moving contact assembly. Similarly the moving contact assembly effects return movement of the limb at the appropriate time.

It is to be understood that in all of the arrangements described above, only minor modifications to the assembly are required to reverse the operation such that the section or sections 24 of the indicator member carry the ON legend while the platform 19 carries the OFF legend.

I claim:

1. An electrical switch including a fixed electrical contact, a movable electrical contact, means for moving the movable contact into and out of engagement with the fixed contact, a first legend carried by a fixed part of the switch and indicative of one of the operative states of the switch, a second legend carried by a means for obscuring, movable relative to said fixed part and indicative of the other operative state of the switch, said means for obscuring being movable between a position wherein the first legend is revealed and the second legend is obscured and a position wherein said means for obscuring obscures the first legend and the second legend is revealed, resilient means urging said means for obscuring to one of said positions, releasable latch means for retaining said means for obscuring in the other of said positions against the action of said resilient means, release means for releasing said latch means at a predetermined point in the movement of the movable contact relative to the fixed contact and return means for returning the means for obscuring to said other position against the action of said resilient means.

2. A switch as claimed in claim 1 wherein said means for obscuring is carried by at least one resilient limb one end of which is fixed, said limb constituting said resilient means.

3. A switch as claimed in claim 1 or claim 2 wherein said means for obscuring is in two relatively movable sections each carrying part of said second legend, said sections being resiliently urged in opposite directions and the two sections jointly obscuring the first legend in the appropriate position.

4. A switch as claimed in claim 3 wherein each of said sections is carried by a respective resilient limb, each limb having one end fixed and constituting the resilient bias of its respective section.

5. A switch as claimed in claim 4 wherein the two limbs are resiliently biassed away from one another and said latch means is defined by a hooked arm on one of the limbs which engages the other limb to hold both limbs against their resilient bias with the two sections of said means for obscuring obscuring the first legend.

6. A switch as claimed in claim 1 or claim 2 wherein said means for obscuring is in two relatively movable sections each carrying part of said second legend, said sections being resiliently urged in opposite directions and the two sections jointly obscuring the first legend in the appropriate position, wherein the movable contact of the switch is resiliently mounted on a carrier, the carrier being moved to move the movable contact and the resilient mounting permitting the carrier to move relative to the movable contact when engaged with the fixed contact so as to apply contact pressure, the latch release means being also carried by said carrier and being arranged to release said latch means when the movable contact has engaged the fixed contact.

* * * * *